US009682258B2

(12) United States Patent
Burgess

(10) Patent No.: US 9,682,258 B2
(45) Date of Patent: Jun. 20, 2017

(54) APPARATUS AND METHOD FOR FIRE SUPPRESSION

(71) Applicant: OCT Pty Ltd, Singleton, New South Wales (AU)

(72) Inventor: Stephen Francis Burgess, Singleton (AU)

(73) Assignee: OCT Pty Ltd, Singleton, New South Wales (AU)

( * ) Notice: Subject to any disclaimer, the term of this patent is extended or adjusted under 35 U.S.C. 154(b) by 4 days.

(21) Appl. No.: 14/915,930

(22) PCT Filed: Aug. 24, 2014

(86) PCT No.: PCT/AU2014/050196
§ 371 (c)(1),
(2) Date: Mar. 2, 2016

(87) PCT Pub. No.: WO2015/031952
PCT Pub. Date: Mar. 12, 2015

(65) Prior Publication Data

US 2016/0206905 A1 Jul. 21, 2016

(30) Foreign Application Priority Data

Sep. 8, 2013 (AU) ..... 2013903436

(51) Int. Cl.
*A62C 2/00* (2006.01)
*A62C 3/07* (2006.01)
(Continued)

(52) U.S. Cl.
CPC ..... *A62C 3/07* (2013.01); *A62C 31/05* (2013.01); *A62C 35/68* (2013.01)

(58) Field of Classification Search
CPC ..... A62C 3/07; A62C 35/68; A62C 31/05
(Continued)

(56) References Cited

U.S. PATENT DOCUMENTS 1,609,762 A 12/1926 Morgan
4,296,817 A * 10/1981 Monte ..... A62C 3/07 169/61
(Continued)

FOREIGN PATENT DOCUMENTS

CN 201329138 10/2009
CN 101869746 10/2010
(Continued)

OTHER PUBLICATIONS

International Search Report of PCT/AU2014/050196 dated Oct. 9, 2014, 5 pages.
(Continued)

*Primary Examiner* — Arthur O Hall
*Assistant Examiner* — Joel Zhou
(74) *Attorney, Agent, or Firm* — Rankin, Hill & Clark LLP

(57) ABSTRACT

An apparatus (10) for delivering a fire suppressant fluid into a vehicle (50), the apparatus (10) including a first funnel (12) in fluid communication with a delivery pipe (14), the funnel (12) being arranged to receive the fire suppressant fluid from a first location external to the vehicle (50) and the delivery pipe (14) extending from the first funnel (12) into the vehicle (50) so as to deliver the fire suppressant fluid within the vehicle (50).

11 Claims, 4 Drawing Sheets

(51) Int. Cl.
*A62C 31/05* (2006.01)
*A62C 35/68* (2006.01)

(58) Field of Classification Search
USPC ..... 169/62
See application file for complete search history.

(56) References Cited

U.S. PATENT DOCUMENTS

| | | | | |
|---|---|---|---|---|
| 5,040,611 | A | 8/1991 | Steel | |
| 5,613,564 | A * | 3/1997 | Rhines | A62C 3/07 169/61 |
| 5,921,323 | A * | 7/1999 | Cronk | A62C 4/04 169/54 |
| 2013/0264073 | A1 * | 10/2013 | Ling | A62C 3/07 169/46 |

FOREIGN PATENT DOCUMENTS

| | | |
|---|---|---|
| EP | 2711052 | 3/2014 |
| GB | 2217668 | 11/1989 |
| GB | 2238473 | 6/1991 |

OTHER PUBLICATIONS

Notification of Transmittal and International Preliminary Report on Patentability of PCT/AU2014/050196 dated Jan. 4, 2016, 19 pages.

* cited by examiner

APPARATUS AND METHOD FOR FIRE SUPPRESSION

TECHNICAL FIELD

The invention relates to an apparatus and method for fire suppression. More specifically, the invention relates to an apparatus and method for delivering a fire suppressant fluid into a vehicle.

BACKGROUND

Vehicles may contain components such as engine components which may become particularly hot during operation. When these components are exposed to flammable substances such as engine oil the flammable substances may ignite and cause a fire within the vehicle.

In mining and construction operations, fire within a vehicle is particularly problematic and the fire must be extinguished quickly and safely. In particular, mining vehicles typically have large diesel motors and turbochargers which are sufficiently hot to ignite engine oil, fuel lines or other flammable substances which are exposed to the motors and/or turbochargers.

Accordingly, such mining vehicles are often fitted with a fire suppressant system. Typically, such systems include a series of fire suppressant delivery pipes which are fitted over and around at risk components of the vehicle. The series of fire suppressant delivery pipes may be connected to an internal source of pressurised fire suppressant via a flow controller. When a fire is detected, the flow controller is configured to release the internal source of pressurised fire suppressant into the delivery pipes which are arranged to deliver a spray of fire suppressant to the components of the vehicle that may be on fire.

A disadvantage of these systems is that the source of pressurised suppressant may become emptied before the fire has been fully extinguished. This may result in the fire reigniting and continuing to burn. Another disadvantage with these systems is that the system may fail.

Some fire suppressant systems may include an inlet nozzle fitted to the vehicle which may be connected to an external source of pressurised fire suppressant. However, this requires the vehicle operator or other person to connect the external source of fire suppressant to the inlet nozzle.

A disadvantage of these systems is that the vehicle operator or other person is required to physically connect the external source of pressurised suppressant to the inlet nozzle which may be particularly hazardous if the vehicle is on fire.

The invention described herein seeks to overcome the above disadvantages or at least provide a useful alternative.

SUMMARY

In accordance with a first aspect there is provided, an apparatus for delivering a fire suppressant fluid into a vehicle, the apparatus including a first funnel in fluid communication with a delivery pipe, the funnel being arranged to receive the fire suppressant fluid from a first location external to the vehicle and the delivery pipe extending from the first funnel into the vehicle so as to deliver the fire suppressant fluid within the vehicle.

In an aspect, the delivery pipe includes a delivery portion having a plurality of apertures.

In another aspect, the plurality of apertures are adapted to provide a spray.

In another aspect, the apparatus further includes a first directional flow device, the first directional flow device being located so as to allow flow of the fire suppressant fluid in a single direction from the first funnel into the delivery pipe.

In another aspect, the apparatus includes a second funnel in fluid communication with the delivery pipe, wherein the second funnel is arranged to receive the fire suppressant fluid from a second location external to the vehicle, and the delivery pipe is arranged to extend between the first and second funnels.

In another aspect, the apparatus includes a second directional flow device being located so as to allow flow of the fire suppressant fluid in a single direction from the second funnel into the delivery pipe.

In another aspect, the first directional flow device is a first one-way valve fitted between the first funnel and a first end of the delivery pipe and the second directional flow device is second one-way valve fitted between the second funnel and a second end of the delivery pipe.

In another aspect, the first funnel and the second funnel are each arranged to be outwardly angled relative to a lengthwise axis of the vehicle.

In another aspect, the vehicle includes a front wall and an engine bay located behind the front wall, wherein the first funnel and the second funnel are supported toward opposing sides of the front wall with the delivery pipe extending internally of the vehicle and over the engine bay.

In another aspect, the first funnel and the second funnels are each outwardly angled toward opposing sides the vehicles.

In another aspect, first funnel and the second funnel are angled at about 45 degrees from the front wall of the vehicle so to be angled toward the opposing sides the vehicles.

In accordance with a second aspect there is provided, a vehicle fitted with an apparatus as defined above.

In accordance with a third aspect there is provided, method of fitting a fire suppressant apparatus to a vehicle, the apparatus including a first funnel, a delivery pipe extending from the first funnel and a one-way valve configured to allow flow from the funnel into the delivery pipe, the method including the steps of: supporting the first funnel of the apparatus at a first location on the vehicle such that a fire suppressant is receivable in the first funnel from a first external location; and arranging a delivery pipe so as to extend into the vehicle to an internal location.

In an aspect, the internal location is an engine bay and method includes the steps of arranging the deliver pipe to extend over the engine bay.

In another aspect, the apparatus includes a second funnel, wherein the method includes the steps of: supporting the second funnel of the apparatus at a second location on the vehicle such that the fire that the fire suppressant is receivable in the second funnel from a second external location; and arranging the delivery pipe to extend between the first funnel and the second funnel with a second one-way valve fitted between the second funnel and the delivery pipe so as to allow flow from the second funnel into the delivery pipe.

In accordance with a forth aspect there is provided, a method of suppressing a fire in a vehicle fitted with an apparatus, the apparatus including a first funnel and a delivery pipe extending from the first funnel, the first funnel being arranged at first location on the vehicle such that a fire suppressant is receivable in the first funnel from a first external location; and the delivery pipe is arranged so as to extend into the vehicle to an internal location, the method including the step of: directing a stream of fire suppressant fluid at the first funnel such that the fire suppressant fluid is received by the first funnel and flows into delivery pipe so as to deliver the fire suppressant fluid to the internal location.

In an aspect, the apparatus includes a second funnel, the second funnel being arranged to be receive the fire fighting fluid from a second location external to the vehicle, wherein the delivery pipe is arranged to extend between the first funnel and the second funnel and wherein the apparatus includes a least one unidirectional flow device fitted between the first and second funnels, wherein the method includes the steps of directing the steam of fire suppressant fluid toward at least one of the first funnel and the second funnel such that suppressant fluid is received by the at least one of the first funnel and second funnel and flows into delivery pipe so as to deliver the fire suppressant fluid to the internal location.

In another aspect, the method includes the step of: positioning a nozzle at least at one of the first and second locations and delivering the tire fighting fluid from the nozzle to at least one of the first funnel and second funnel.

In yet another aspect, the internal location is at least one of adjacent to or within an engine bay of the vehicle.

BRIEF DESCRIPTION OF THE FIGURES

The invention is described, by way of non-limiting example only, by reference to the accompanying figures, in which.

DETAILED DESCRIPTION

Figure 1:
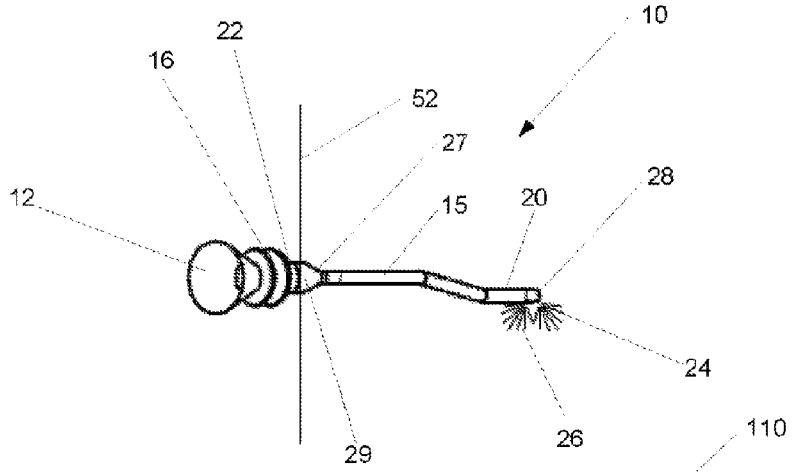
FIG. 1 is a side perspective view illustrating a first example of the apparatus having a first funnel connected to a delivery pipe.
Figure 8:
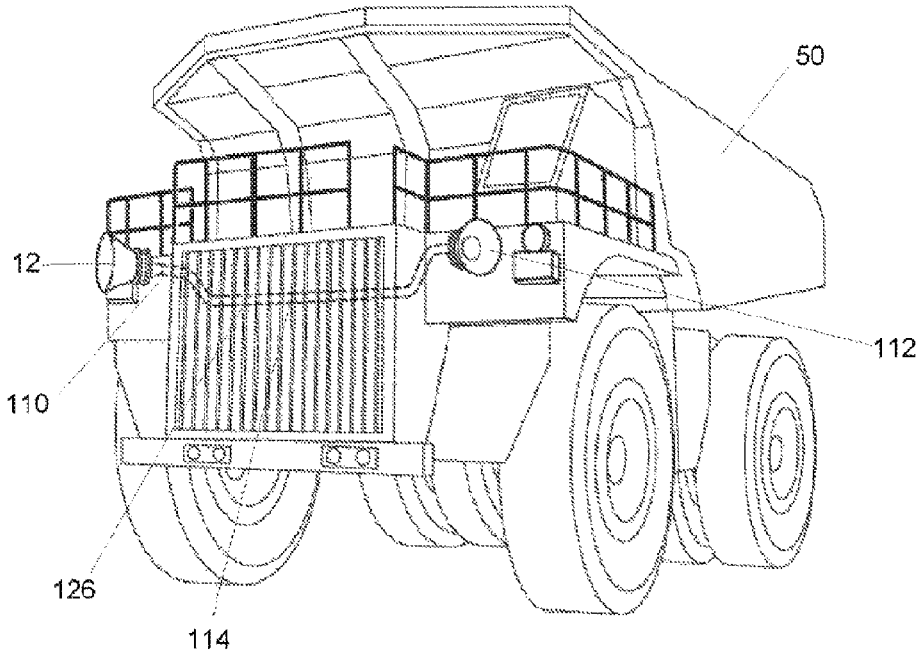
FIG. 8 is a front perspective view illustrating an example of a vehicle to which the apparatus may be fitted.

Referring to FIG. 1, there is shown an example of an apparatus 10 for delivering a fire suppressant fluid into a vehicle or machine 50 (best shown in FIG. 8). The apparatus 10 including a first funnel 12 in fluid communication with a delivery pipe 14. The first funnel 12 is arranged to receive the fire suppressant fluid from a first location external to the vehicle 50 and the delivery pipe 14 is arranged to extend from the first funnel 12 into the vehicle 50 so as to deliver the fire suppressant fluid within the vehicle 50.

The apparatus 10 includes a first directional flow device 16 which is located so as to allow flow of the fire suppressant fluid in a single direction from the first funnel 12 into the delivery pipe 14. In this example, the first directional flow device 16 is provided in the form of a first one-way valve 22 fitted between the first funnel 12 and the delivery pipe 14.

The delivery pipe 14 includes a transport portion 15 connected to the first one-way valve 22 and a delivery portion 20 having a plurality of apertures 24 therein. The delivery portion 20 may be adapted to provide a downward facing spray thereby providing a spray bar outlet 26.

In this example, the delivery pipe 14 has a closed end 28 provided after the spray bar 26. This ensures that once the fire suppressant fluid enters the first one-way valve 22, the delivery pipe 14 becomes pressurised so as to deliver the fire suppressant fluid from the spray bar outlet 26. The delivery pipe 14 may also include a neck or restriction 29 between the first one-way valve 22 and the smaller diameter transport portion 15 of the delivery pipe 14.

The apparatus 10, in particular, the funnel 12 may be fitted to a surface 51, more specifically, a front wall surface 52 of the vehicle 50 so as to be accessible from a first external location. The first funnel 12 may be arranged so as to be angled relative to the vehicle 50, in particular the front wall surface 52, so as to receive a jet or spray of the fire suppressant fluid which is directed at the first funnel 12 from a first location external to the vehicle, as is further detailed below.

In some examples, the delivery pipe 14 may include an angled portion 27 which angles the axis of a throat of the funnel 12 at about 45 degrees to the side wall surface 52. In this example, the delivery pipe 14 may have a length of about 0.5 to 2.5 m and the diameter of the delivery pipe 14 may be in the range of about 0.05 to 0.2 m.

Figure 2:
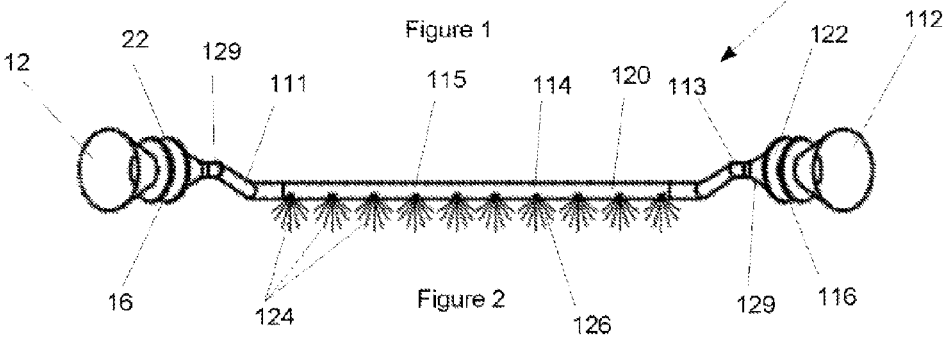
FIG. 2 is a side perspective view illustrating a second example of the apparatus having a first funnel, a second funnel and delivery pipe extending between the first funnel and the second funnel.

Referring to FIG. 2, there is shown a second example of the apparatus 110 in which like parts are identified with like numerals. This example of the apparatus 110 includes a second funnel 112 fitted to an opposing end of the delivery pipe 14 such that the delivery pipe 114 extends between the first funnel 12 and the second funnel 112.

Similarly to the first funnel 12, the second funnel 112 is arranged to receive the fire suppressant fluid from a second location external to the vehicle 50. The apparatus 110 includes a second directional flow device 116 being located so as to allow flow of the fire suppressant fluid in a single direction from the second funnel 112 into the delivery pipe 114.

More specifically, in this example, the apparatus 110 includes the first directional flow device 16 provided in the form of the first one-way valve 22 fitted between the first funnel 12 and a first end 111 of the delivery pipe 114 and the second flow directional flow device 116 is provided is the form of a second one-way valve 122 which fitted between the second funnel 112 and a second end 113 of the delivery pipe 114. Each of the first and second one-way valves 22, 122 are configured to allow the fire suppressant fluid to enter, but not exit, the delivery pipe 114 from the respect first and second funnels 12, 112.

The delivery pipe 114 includes a delivery portion 120 between transport portions 115. The delivery portion 120 includes a plurality of apertures 124 which may be configured to provide a downward facing spray such that the delivery portion 120 provides a spray bar 126. The delivery pipe 114 may also include necks or restrictions 129 which are each located between the first one-way valve 22 and the second one-way valve 122 and the smaller diameter transport portions 115 of the delivery pipe 114.

Figure 3:
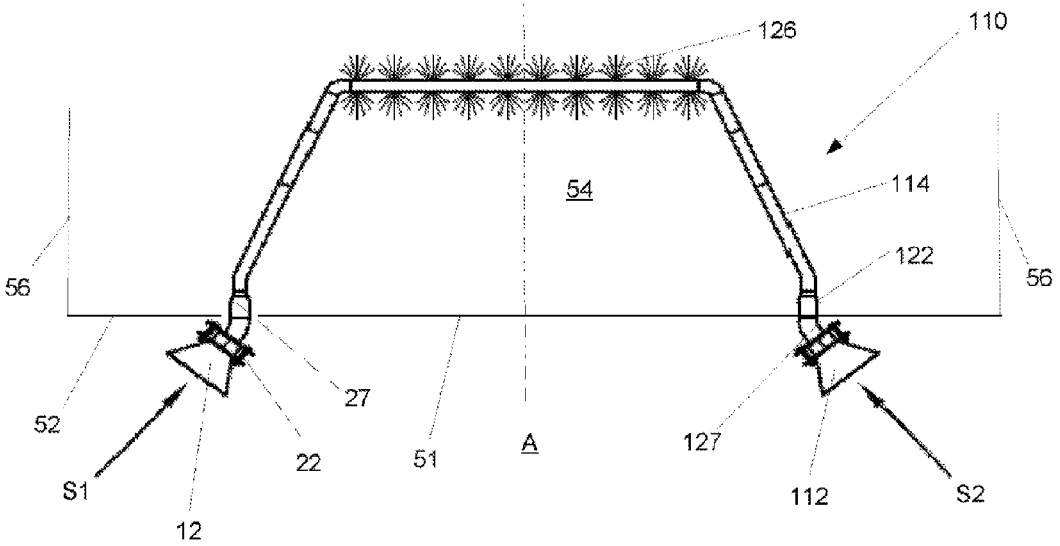
FIG. 3 is a view illustrating the second example.

Referring additionally to FIG. 3, the vehicle 50 includes a front wall 52 and an engine bay area 54 located behind the front wall 52. The first funnel 12 and the second funnel 14 are supported toward opposing sides of the front wall 52 with the delivery pipe extending internally of the vehicle 50 and over the engine bay 54.

In this example, the first funnel 12 and the second funnel 112 may be angled so as to face away or outwardly from one another toward opposing sides 56 of the vehicle 50 (as best shown in FIGS. 7 to 10). Accordingly, the first funnel 12 and the second funnel 112 are each arranged to be outwardly angled relative to a lengthwise axis (A) of the vehicle 12.

In some examples, the delivery pipe 114 may include angled portions or bends 27, 127 which angle the axis of throats of the funnels 12, 112 at about 45 degrees to the side wall surface 56. In this example, the delivery pipe 114 may have a length of about 1.0 to 2.5 meters and the diameter of the delivery pipe 114 may be in the range of about 0.05 to 0.2 m.

Accordingly, the outward angling of the first funnel 12 and second funnel 112 allows the fire suppressant fluid to be directed in a stream from two separate external locations S1, S2 and received within at least one of the first funnel 12 and the second funnel 112.

Figure 4:
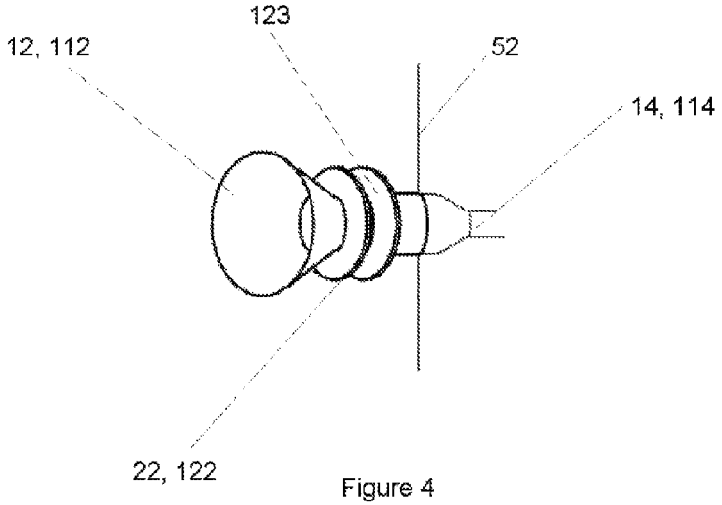
FIG. 4 is a side perspective detail view of one of the funnels and one-way valves.

Referring to FIG. 4, in the examples provided above, the funnels 12, 112 may have a generally frustoconical shape having an inlet or opening diameter of about 0.2 to 0.6 meters and taper to an outlet or throat diameter of between about 0.05 and 0.15 m. The length of the funnel 12 may be between about 0.3 and 0.75 m.

The first and second one-way valves 22, 122 may be fitted directly between the throat outlet of the funnel 12, 112 and the inlet of the delivery pipe 114. Each of the first and second one-way valves 22, 122 are operable, by fluid flow, between a normally closed condition and an operable open condition to allow selective unidirectional flow into the delivery pipe 14, 114 via the funnels 12, 122. Preferably, the one-way valves 22, 122 are single door wafer-style butterfly check valves.

More specifically, the valves 22, 122 include a valve body 123 and a spring activated valve (not shown) biased by a spring to blind or close the valves 22, 122 in a normally closed condition. The valve may be disk shaped and secured to the valve body 123 by a central hinge which also supports the spring. The valves 22, 122 are arranged to be urged open by the stream of the fire suppressant fluid flowing from the funnels 12, 122 into the delivery pipe 114. However, the valves 22, 122 maintain a normally closed condition to prevent back-flow thereby only allowing unidirectional flow into the delivery pipe 114.

The funnels 12, 122 and delivery pipe 114 may be formed from steel, preferably a high temperature stainless steel or similar suitably fire resistance material. The delivery pipes 14, 114 may be formed from of any suitably shaped cross section such as circular or slotted, and the apertures 124 may be drilled or pressed along the delivery pipe to form the spray bar 126. The apertures 124 may also include or be fitted with nozzles or other similar flow delivery devices which are used to create a spray pattern and/or direct the fire suppressant fluid in a particular direction such as a downward or lateral direction relative to the spray bar 126.

Figure 5:
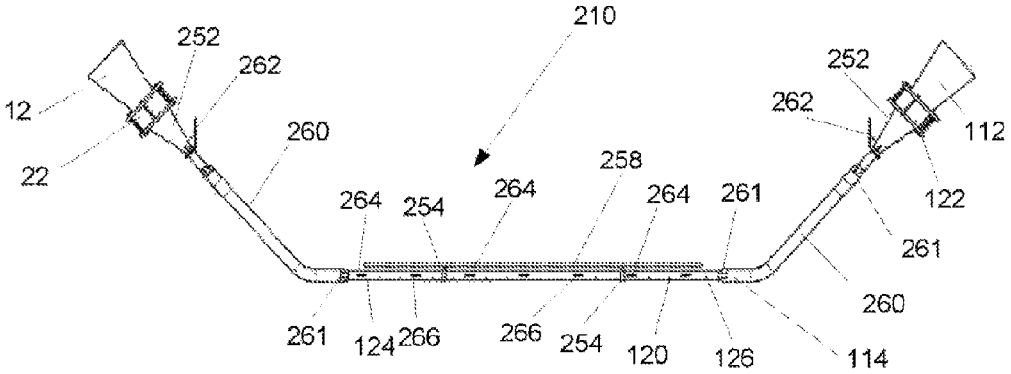
FIG. 5 is an underside view illustrating a third example of the apparatus having a first funnel, a second funnel and delivery pipe extending between the first funnel and the second funnel.
Figure 6:
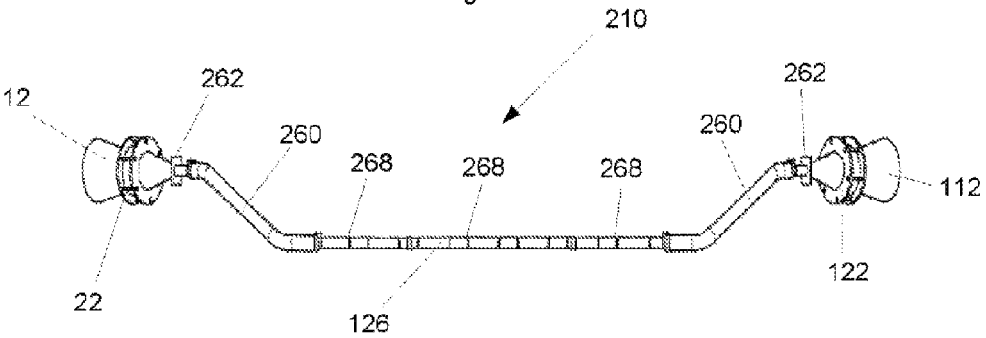
FIG. 6 is a rear view illustrating a the third example of the apparatus.
Figure 7:
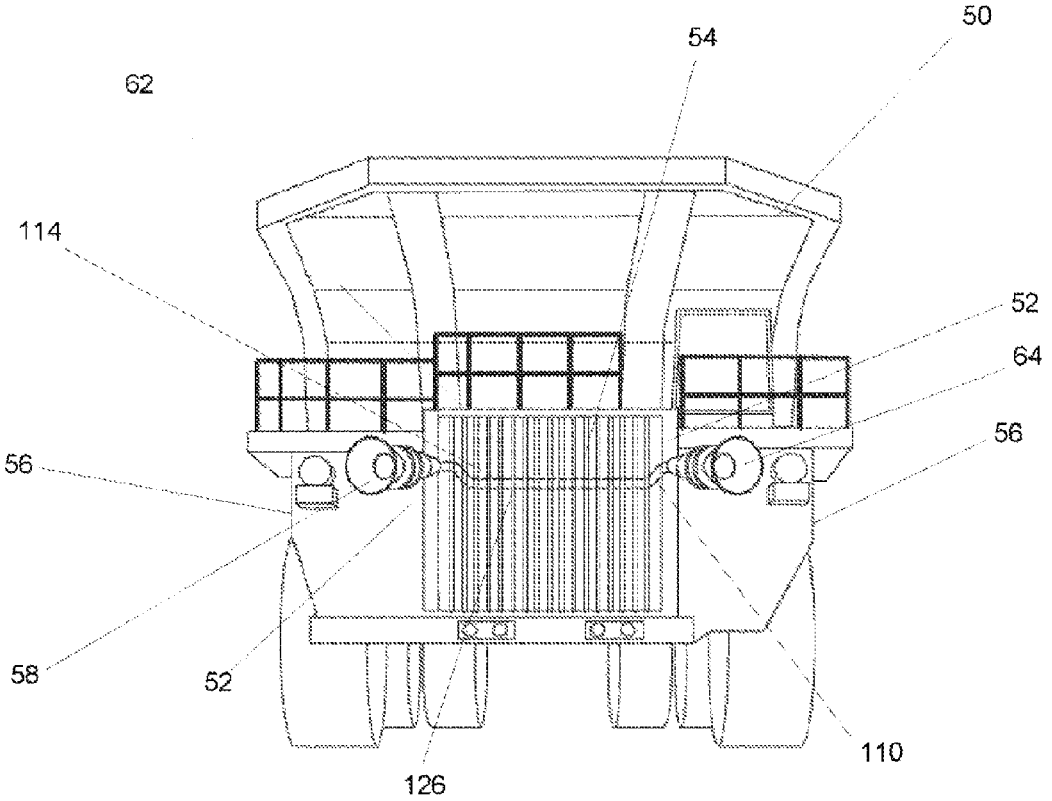
FIG. 7 is a front view illustrating an example of a vehicle to which the apparatus may be fitted.

Referring to FIGS. 5 and 6, there is shown a third example of the apparatus 210 in which like parts are identified with like numerals. This example of the apparatus is similarly configured to the example of the apparatus described above.

However, in this example, the delivery pipe 114 includes flexible pipe sections 260 between the delivery portion 120 in the form of the spray bar 126 and the funnels 12, 112. The apparatus 210 also includes funnel shaped transition sections 252 which couple the respective ends of the flexible pipe sections 260 to the valves 22, 122. The valves 22, 122 then directly support and are coupled to the delivery funnels 12, 112. Each end of the flexible pipe sections 260 is coupled to the respective transition sections 252 and ends of the spray bar 126 by clamps 261.

Figure 10:
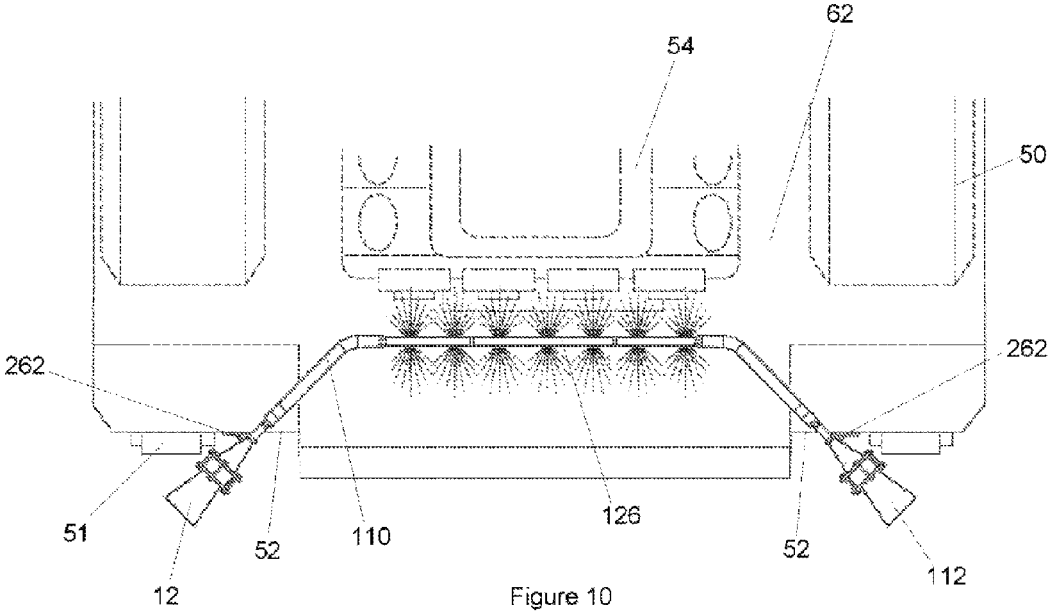
FIG. 10 is a top sectional view illustrating an example of the apparatus fitted to the vehicle and extending over and in front of the engine bay so as to deliver fire suppressant to the engine bay.

In this example, the apparatus 210 also includes support brackets 262 coupled to the funnel shaped transition sections 252. The support brackets 262 are adapted to attach and support the funnels 12, 112 to the front wall 52 of the truck as is best shown in FIG. 10. The spray bar 126 is also coupled via pipe clamps 254 to an elongate mounting bar 258 which is used to support or suspend the spray bar 126 within the engine bay 54 of the truck 50 as is best shown in FIGS. 8 and 10.

In this example, the spray bar 126 is a relatively straight section with each of the opposing ends received by and connected to the flexible pipe sections 260. The apertures 124 are provided in form of a slot arrangement 264 including lengthwise slots 266 (shown in FIG. 5) and horizontal or radial slots 268 (shown in FIG. 8). The lengthwise slots 266 and radial slots 268 are provided in an alternating arrangement extending along the spray bar 126 to deliver the fire suppressant fluid both laterality and vertically from the spray bar 126.

In this example, the spray bar 126 has a diameter of about 50 mm and is formed from stainless steel. The length of the spray bar 126 is about 1800 mm. However, the length may be adapted to specific vehicles. The funnels 12, 122 and the transition sections 252 are also formed from stainless steel and the flexible pipe sections 260 are made from a high temperature rubber or metallic material such as annular stainless steel braid hoses supplied by HoseFlex™. Other suitable arrangements and sizes may also be utilised. The slots of the slot arrangement 264 may have a length of about 40-50 mm and a width of about 3 mm. The flexible pipe sections 260 may have a diameter of about 50 to 65 mm, and the valves 22, 122 may be Duo Check Crane Wafer Valve CI 200 mm. Other size valves may also be used depending on the pipe and funnel sizing.

The funnels 12, 112 have a gradual taper, of about 30 degrees, from a mouth of having a diameter of about 300 mm to a neck of about 200 mm where the funnels 12, 112 connect to the valves 22, 122. The transition sections 252 are arranged to have a straight section or maintain a space immediately downstream of the valves 22, 122 to as to allow the wafer valve to fully swing open when impacted by the fluid stream and such that the wafer valve is not obstructed by the transition sections 252. The transition sections 252 then gradually taper, again at about 30 degrees, from a diameter of about 200 mm to a diameter of about 65 to 50 mm to fit with the flexible pipe sections 260.

Figure 9:
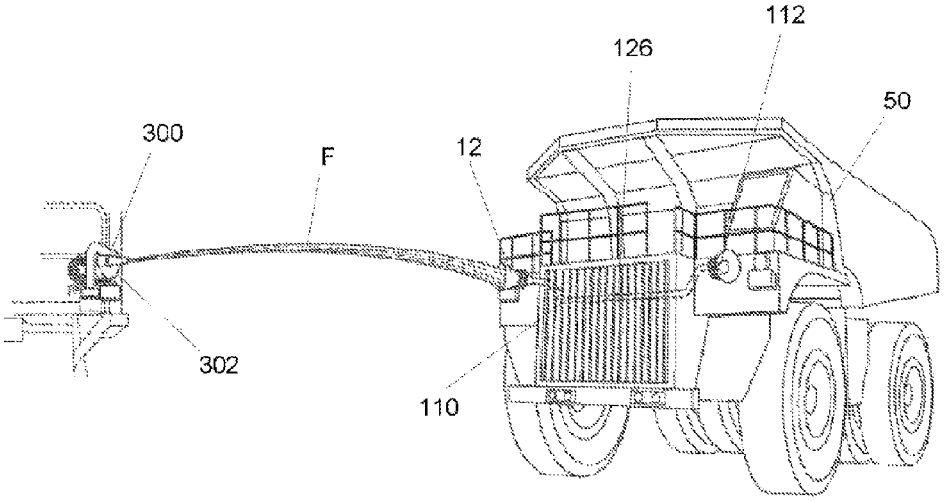
FIG. 9 is a front perspective view illustrating a nozzle directing a stream of fire suppressant fluid into one of the funnels of the vehicle.

Referring to FIGS. 7 to 10, the apparatus 110 may be fitted to the vehicle 50 which is in this example a mining dump truck. However, the apparatus 10, 110 may also be fitted to other types of vehicles such as diggers. The apparatus 10, 110 may be fitted by a method including the steps of: supporting the first funnel 12 of the apparatus 10, 112 at a first location 58 on the vehicle 50 such that a fire suppressant is receivable in the first funnel 12 from a first external location; and arranging the delivery pipe 14, 114 so as to extend into the vehicle to an internal location 62. In this example, the internal location 62 is the engine bay 54 and the method includes the steps of arranging the delivery pipe 14, 114 to extend over or above the engine bay 54.

Where the apparatus 110 includes the second funnel 112, the method may include the further steps of: supporting the second funnel 112 of the apparatus at a second location 64 on the vehicle 50 such that the fire suppressant is receivable in the second funnel 112 from a second external location; and arranging the delivery pipe 114 to extend between the first funnel 12 and the second funnel 112. In this example, the first and second external locations will be the location of the cannon 300 as shown in FIG. 9.

The delivery pipe 114 is preferably arranged with the spray bar 126 over or adjacent to an engine or engine components within the engine bay 54 and the brackets 262 are used to support and secure the apparatus 110 to the front wall 52 of the truck 50 (as is best shown in FIG. 10). The apparatus 10,110 may be retro-fitted to the vehicle 50 and may require holes to be formed in the front wall 52 of the truck 50 to accommodate the apparatus 10, 110.

In this arrangement, the apparatus 110 provides two funnels 12, 112 which are angled to receive a stream or jet of fire suppressant fluid which is directed at one of the two funnels 12, 112. The fire suppressant fluid proceeds through one of the two funnels 12, 112, and moves or urges the respective one of the one-way valves 22, 122 into the open condition. The fire suppressant fluid flows through the open one of the respective one-way valves 22, 122 into the delivery pipe 114.

During this process, the other of the one-way valves 22, 112 is maintained in the closed condition which results in an increased pressure or pressurisation within the delivery pipe 114. The now pressurised fire suppressant fluid then proceeds through the apertures 124 of the spray bar 126 and forms a fire retardant aerated spray over the engine bay 54. As may be appreciated, the apparatus 110 is symmetrical or reversible and may be used by directing a jet or stream of the fire suppressant fluid at either of the funnels 12, 112.

This reversible characteristic is important because, in use, the vehicle 50 may be located against a wall or only accessible from one side. Accordingly, the fire suppressant fluid may only be able to be directed at the vehicle from one side or at an angle to the vehicle. Accordingly, having the funnels 12, 112 located at spaced apart locations and being outwardly angled increases to access to the funnels 12, 112 and allows the fire suppressant to be directed to the vehicle 50 from at least two different external locations.

Referring more specifically to FIG. 9, the fire suppressant fluid is typically supplied by a high pressure fire hose or a cannon 300 which is capable of projecting the fire suppressant fluid between approximately 40 m and 75 m. The cannon 300 includes a nozzle 302 which is arranged to deliver a relatively narrow jet of the fire suppressant fluid, indicated by "F" in FIG. 9, to the respective funnels 12, 112. Preferably, the cannon 300 should be located about 10 to 15 meters from the respective funnels 12, 112 to ensure maximum flow velocity at the funnels 12, 112 also to maintain a relatively thin jet or stream of the fire suppressant fluid.

Such cannons 300 may be capable of delivering about 22 to 33 L/s of the fire suppressant fluid. Typically, the cannon 300 is coupled to a water cart which may include a water pump and fire suppressant additive which is added to the water. In some examples, where the pump delivers about 22 L/S the nozzle 302 may a 1¼ inch size nozzle and in other examples where the pump delivers about 33 L/S a the nozzle 302 may be a 1¾% size nozzle.

In the example provided, the first and second external locations from which the fire suppressant fluid is directed at either of the first or second funnels 12, 112 is therefore less than about 40 m to 75 m from the funnels 12, 112. Preferably, to ensure the stream of fire suppressant fluid is sufficiently narrow to be captured by the funnels 12, 112, the first and second locations may be less than approximately 40 m and most preferably approximately less than 20 m from the funnels 12, 112. The smaller distances between the first and second locations and the funnels 12, 112 also ensure that the velocity of the fluid and hence energy of the fluid is maintained and energy losses to air resistance are minimised.

To maintain pressurisation of the apparatus 10, 100, during operation a continuous stream or jet of the fire fighting fluid is maintained impacting and received by the funnels 12, 112. Typically, this stream is maintained for a minimum time of 10 to 30 seconds to charge the apparatus 10,100 and ensure pressurised spray has been delivered from the apertures 124 of the spray bar 126. The fire suppressant fluid used in these operations is typically 90% water and 10% foaming fire suppressant. The overall length of time of maintaining the continuous stream or jet of the fire fighting fluid should be sufficient to extinguish the fire, and may, in some examples be in the order of minutes to tens of minutes.

Advantageously, the above-described apparatus provides a secondary or backup fire suppression system whereby a the suppressant fluid may be delivered into a vehicle or machine from a location remote to the vehicle. This is particularly important in instances where the primary fire suppression system has failed and it is unsafe to attempt to suppress the fire by directly attaching, for example, a fire suppressant delivery hose directly to the vehicle. The vehicle or machine may be any suitable vehicle or machine. For example, the apparatus may be fitted to mining vehicles or dump trucks, or earthmoving machinery used for construction.

In particular, the above described fire suppression apparatus and methods of use allow a jet or stream of fire suppressant fluid to be directed at the funnels from external locations which may be in the order of approximately 10 to 20 m from the vehicle or machine and the fire suppressant fluid captured by the funnels is directed internally of the vehicle and preferably over or adjacent to the engine bay where there may be heated components, such as turbos, which are likely to ignite any fuels within the engine bay such as fuel from fuel lines or engine oil. Having two funnels which are both outwardly angled is also advantageous because it allows for the stream of fire suppressant fluid to be directed at the funnels from either side of the vehicle. This is important because there may be situations where the vehicle is only accessible from one side such as when the vehicle is against a wall.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any known matter or any prior publication is not, and should not be taken to be, an acknowledgment or admission or suggestion that the known matter or prior art publication forms part of the common general knowledge in the field to which this specification relates.

While specific examples of the invention have been described, it will be understood that the invention extends to alternative combinations of the features disclosed or evident from the disclosure provided herein.

Many and various modifications will be apparent to those skilled in the an without departing from the scope of the invention disclosed or evident from the disclosure provided herein.

The claims defining the Invention are as follows:

1. An apparatus for delivering a fire suppressant fluid into a vehicle, the apparatus including first and second funnels in fluid communication with a delivery pipe extending between the first and second funnels, the delivery pipe including a delivery portion adapted to deliver the fire suppressant fluid into the vehicle, and first and second directional flow devices located between the respective first and second funnels and the delivery portion, wherein the first and second funnels are adapted to receive a stream of the fire suppressant fluid dispensed from respective first and second locations that are each remote to the respective first and second funnels and external to the vehicle, and direct the received stream of the fire suppressant fluid to respective ones of the first and second directional flow devices so as to move the respective ones of the first and second directional flow devices between a normally closed condition and an open condition so as to each allow one-way flow of the received stream of fire suppressant fluid from the respective first and second funnels into the delivery portion thereby delivering the fire suppressant fluid within the vehicle, and wherein the first funnel and the second funnel are each arranged to be outwardly angled relative to a lengthwise axis of the vehicle.

2. The apparatus according to claim 1, wherein the delivery portion includes a plurality of apertures.

3. The apparatus according to claim 2, wherein the plurality of apertures are adapted to provide a spray.

4. The apparatus according to claim 1, wherein the first directional flow device is a first one-way valve fitted between the first funnel and a first end of the delivery pipe and the second directional flow device is a second one-way valve fitted between the second funnel and a second end of the delivery pipe.

5. The apparatus according to claim 1, wherein the vehicle includes a front wall and an engine bay located behind the front wall, wherein the first funnel and the second funnel are supported toward opposing sides of the front wall with the delivery pipe extending internally of the vehicle and over the engine bay.

6. The apparatus according to claim 5, wherein the first funnel and the second funnel are each outwardly angled toward opposing sides the vehicles.

7. The apparatus according to claim 6, wherein the first funnel and the second funnel are angled at about 45 degrees from the front wall of the vehicle so to be angled toward the opposing sides the vehicles.

8. A method of suppressing a fire in a vehicle fitted with an apparatus using a fire suppressant fluid, the apparatus including a first funnel, a second funnel, and a delivery pipe extending between the first and second funnels, the delivery pipe including a delivery portion adapted to deliver the fire suppressant fluid to an internal location of the vehicle, wherein first and second directional flow devices are located between the respective first and second funnels and the delivery portion, and wherein the first and second funnels are arranged at respective first and second locations on the vehicle, are outwardly angled relative to a lengthwise axis of the vehicle and are adapted such that a stream of the fire suppressant fluid is receivable by the first and second funnels from respective first and second locations that are each remote to the first and second funnels and external of the vehicle, the method including the step of: directing a stream of fire suppressant fluid to at least one of the first and second funnels from at least one of the first and second locations such that the stream of fire suppressant fluid is received by at least one of the first and second funnels and is directed by the at least one of the first and second funnels to move a respective one of the first and second directional flow devices from a normally closed condition to an open condition such that the stream of fire suppressant fluid flows one-way through the respective first and second directional flow devices into the delivery portion so as to deliver the fire suppressant fluid to the internal location.

9. The method according to claim 8, wherein the method includes the step of: positioning a nozzle at least at one of the remote and external first and second locations and delivering the stream of fire suppressant fluid from the nozzle to at least one of the first funnel and the second funnel.

10. The method according to claim 8, wherein the internal location is at least one of adjacent to or within an engine bay of the vehicle.

11. The apparatus according to claim 4, wherein each of the first and second one-way valves is a spring activated wafer-style butterfly check valve.

* * * * *